US005342280A

United States Patent [19]

Niinai et al.

[11] Patent Number: 5,342,280

[45] Date of Patent: Aug. 30, 1994

[54] SYSTEM FOR MANAGEMENT OF BODY ROTATION OF CENTRIFUGE

[75] Inventors: Yoshitaka Niinai; Akio Nagata; Norihisa Sagawa, all of Katsuta; Shigeru Shinohara, Mito; Eiji Nakayama, Katsuta; Mitsutoshi Yotsuyanagi, Katsuta; Hiroshi Hayasaka, Katsuta; Kazuyoshi Tokunaga, Katsuta, all of Japan

[73] Assignee: Hitachi Koki Company Limited, Tokyo, Japan

[21] Appl. No.: 107,428

[22] Filed: Aug. 17, 1993

Related U.S. Application Data

[63] Continuation of Ser. No. 623,852, Dec. 7, 1990, abandoned.

[30] Foreign Application Priority Data

| | | | |
|---|---|---|---|
| Dec. 8, 1989 | [JP] | Japan | 1-319371 |
| Sep. 29, 1990 | [JP] | Japan | 2-262876 |
| Oct. 12, 1990 | [JP] | Japan | 2-107000[U] |
| Oct. 12, 1990 | [JP] | Japan | 2-107002[U] |
| Oct. 12, 1990 | [JP] | Japan | 2-107003[U] |
| Oct. 26, 1990 | [JP] | Japan | 2-290520 |
| Oct. 26, 1990 | [JP] | Japan | 2-290521 |
| Oct. 26, 1990 | [JP] | Japan | 2-290522 |

[51] Int. Cl.[5] ..... B04B 15/00

[52] U.S. Cl. ..... 494/10; 364/565

[58] Field of Search ..... 494/7, 10, 9, 84, 85; 360/1; 364/496, 565; 324/172

[56] References Cited

U.S. PATENT DOCUMENTS

| | | | |
|---|---|---|---|
| 3,264,453 | 8/1966 | Barnard | 360/27 |
| 3,746,247 | 7/1973 | Camilliere | 494/10 |
| 4,133,642 | 1/1979 | Nosaka | 360/1 |
| 4,205,261 | 5/1980 | Franklin | 494/10 |
| 4,241,403 | 12/1980 | Schultz | 364/565 |
| 4,244,513 | 1/1981 | Fayer | 494/10 |
| 4,379,256 | 4/1983 | Maury | 364/565 |
| 4,394,701 | 7/1983 | Igata | 360/27 |
| 4,601,696 | 7/1986 | Kamm | 494/10 |
| 4,734,804 | 3/1988 | Hanabusa | 360/104 |
| 4,772,254 | 9/1988 | Grassl et al. . | |
| 4,777,611 | 10/1988 | Tashiro | 364/565 |
| 4,827,197 | 5/1989 | Giebeler | 494/9 |
| 4,841,397 | 6/1989 | Maeda | 360/105 |

FOREIGN PATENT DOCUMENTS

| | | |
|---|---|---|
| 344443 | 12/1989 | European Pat. Off. . |
| 3815449 | 11/1989 | Fed. Rep. of Germany . |
| 8703677 | 6/1987 | PCT Int'l Appl. . |

*Primary Examiner*—Timothy F. Simone
*Assistant Examiner*—Randall E. Chin
*Attorney, Agent, or Firm*—Lowe, Price, LeBlanc & Becker

[57] ABSTRACT

A management system for use in a centrifuge equipped with a detachable rotor which is rotatable so as to separate density-different samples by a centrifugal force due to the rotation. The management system is for managing the lifetime of the rotor on the basis of the detection results of an operated-condition detector for detecting operated conditions such as the number of times of rotation, running time and rotational speed of the rotor. The management system includes a data storing device which is provided on the rotor to be rotatable therewith and is composed of a magnetic recording medium to allow keeping data relating to the operated conditions of the rotor. Also included in the management system is a data processing unit coupled through a data reading and writing device such as a magnetic head to the data keeping device and also coupled to the operated-condition detector to be responsive to the operated conditions. The data processing unit reads out previous data from the data keeping device at the time of start of operation of the centrifuge, processes the operated conditions from the detector together with the read previous data to write on the data storing device new data produced by the data processing.

12 Claims, 9 Drawing Sheets

SYSTEM FOR MANAGEMENT OF BODY ROTATION OF CENTRIFUGE

This application is a continuation of application Ser. No. 07/623,852 filed Dec. 7, 1990 now abandoned.

BACKGROUND OF THE INVENTION

The present invention relates generally to centrifuges, and more particularly to a system of managing the lifetime of a body of rotation (which will be referred hereinafter to as a rotor) of a centrifuge on the basis of the used or operated conditions of the rotor.

For use of centriguges, limitation is essentially imposed upon the life-time of its rotor depending on the operated conditions such as the number of times of rotations, frequency of use, rotational speed and the integrated working or running time. The rotor is exposed to a considerable centrifugal stress due to its high-velocity rotation and finally damaged when exceeding allowable conditions. Thus, in order to avoid this damage of the rotor, it is required to manage the operated conditions. There is a problem, however, in that the management imposes a burden on the user. One possible solution is to magnetically detect the operation of the rotor so as to store the operated conditions in a memory as described in U.S. Pat. No. 4,772,254. However, difficulty is encountered to use the rotor for a different centrifuge and there is the possibility that excessive discharging of a battery continuously powering the memory causes undesirable erasure of the stored data.

SUMMARY OF THE INVENTION

It is therefore an object of the present invention to provide a management system for use in a centrifuge which is capable of accurately and surely managing the lifetime of a rotor for separating density-different samples by a centrifugal force due to its rotation.

With this object and other features which will become apparent as the description proceeds, in accordance with the present invention, there is provided a management system for use in a centrifuge equipped with a detachable rotor which is rotatable so as to separate density-different samples by a centrifugal force due to the rotation, said management system comprising: detection means for detecting operated conditions of the rotor; and data storing means provided on the rotor for writing and reading out data. Preferably, the management system comprises data processing means responsive to the operated conditions detected by the detection means for recording the operated conditions and reading out it on and from the data keeping means. The data storing means is composed of a magnetic recording medium and the data processing means includes a magnetic head so as to record and read the operation data through the magnetic head on and from the data storing means. Preferably, a width of the magnetic recording medium in directions of the axis of the rotor is shorter than a width of the magnetic head in the same directions and the magnetic head is arranged to be separated by a predetermined distance from the data storing means in response to a control signal generated from the data processing means when the rotor is stopping and rotating at a speed higher than a predetermined speed.

The management system further comprises setting means for setting to the centrifuge operating conditions corresponding to the operated conditions read out by the data processing means from the data storing means so that the centrifuge is automatically operable in accordance with the operated conditions. Furthermore, the management system includes memory means coupled to the data processing means for storing and taking out data and alarm means coupled to the data processing means for giving an alarm. The data processing means reads out the operated conditions from the data storing means at the time of start of the operation of the centrifuge and records new operated conditions thereon at the time of completion of the operation of the centrifuge, and compares the operated conditions read out from the data storing means with allowable conditions taken out from the memory means and operates the alarm means in accordance with the comparison results. Moreover, the detection means detects rotational speeds of the rotor at every use of the centrifuge, and the data processing means comprises means for classifying the maximum speed of the detected rotational speeds in accordance with a predetermined classifying system, rate-calculating means for calculating a rate for each class, and summing means for summing the calculated rates, and comparing means for comparing the summed value with a predetermined value so as to manage the rotor in accordance with the comparison results. Further, the detection means detects rotational speeds of the rotor, and the data processing means comprises means for calculating a ratio of the detected rotational speed to a predetermined value at every use of the centrifuge, adding means for adding the calculated ratio to the previously calculated ratio at every use of the centrifuge, and comparing means for comparing the addition value with a predetermined value to manage the rotor in accordance with the comparison results.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE INVENTION

Figure 1:
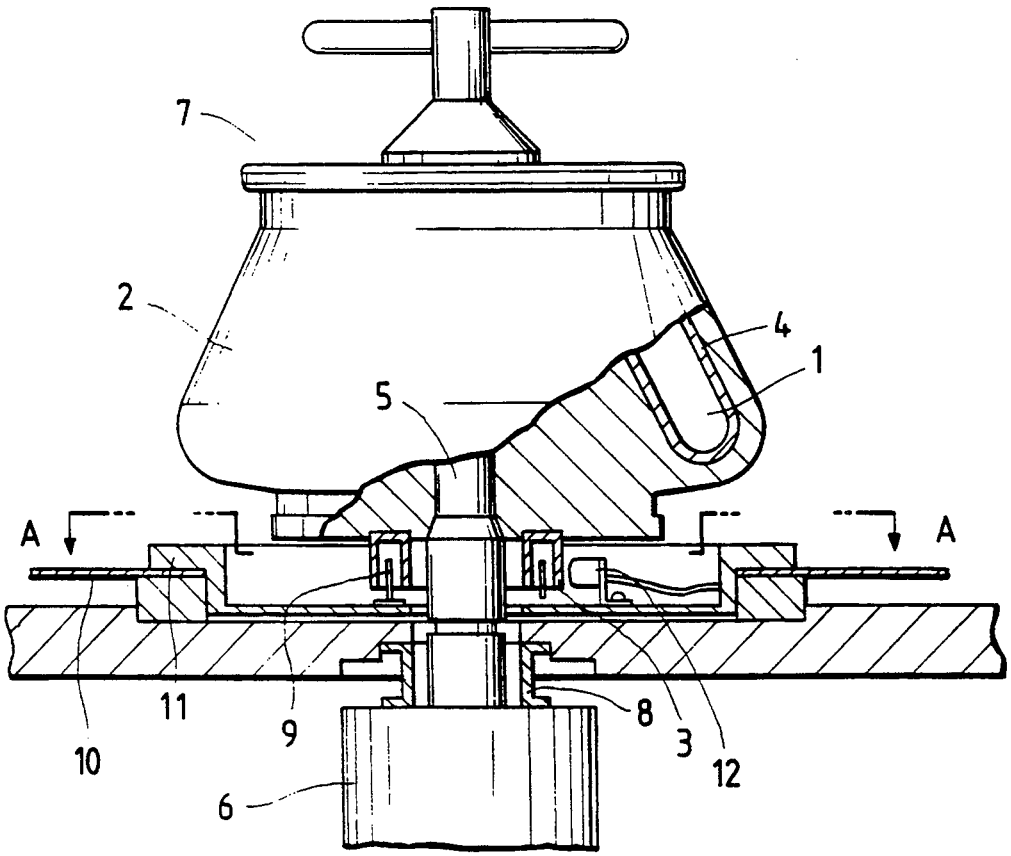
FIG. 1 is a partial cross-sectional view showing a management system according to a first embodiment of the present invention which is incorporated into a centrifuge.

Referring now to FIG. 1, there is partially illustrated a centrifuge equipped with a rotor, which is for separating samples whose densities are different from each other. In FIG. 1, the rotor, illustrated at numeral 2, is arranged to accommodate therein tubes 4 for encasing samples 1 and engaged coaxially with one end portion of a hub 5 the other end portion of which is coupled to a driving apparatus 6 so that the rotor 2 is rotatable at a high speed. The rotor 2 is encased in a rotation chamber 7 of the centrifuge and the rotation chamber 7 is arranged to be decompressed during rotation of the rotor 2 in order to reduce the windage loss, and vacuum-sealed by means of a bellows 8. Illustrated at numeral 9 is a thermosensible ring for measuring the temperature of the rotor 2 and illustrated at numeral 10 is an evaporator for cooling the rotor 2 in accordance with the measurement results of the thermosensible ring 9 so as to cause the temperature of the rotor 2 to become constant.

Figure 2:
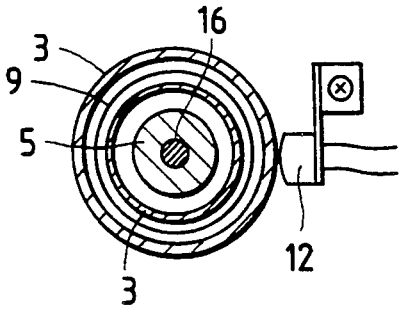
FIG. 2 is a cross-sectional view taken along line A—A in FIG. 1.
Figure 3:
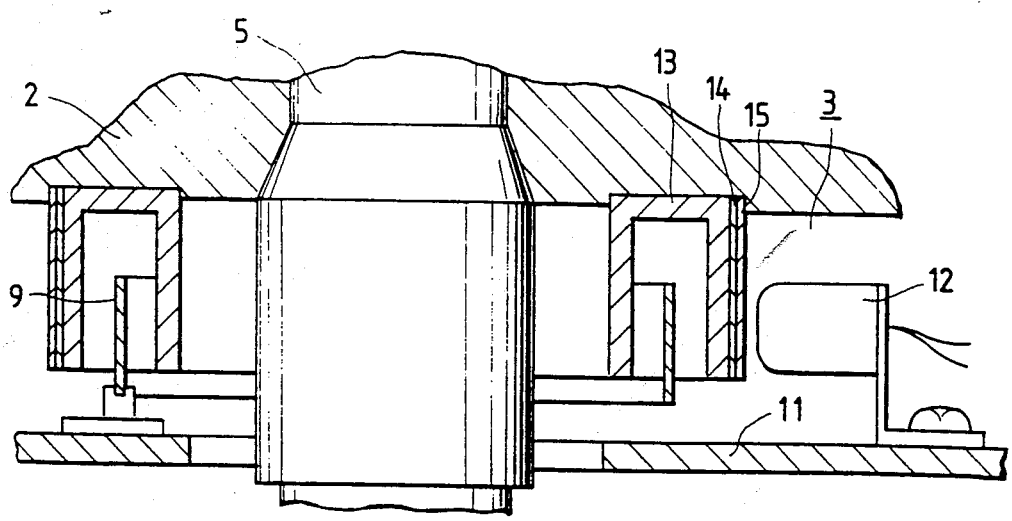
FIG. 3 is a cross-sectional view of a principal portion of the management system illustrated in FIG. 1.

On a lower portion of the rotor 2 is provided a data keeping device 3 which has a cylindrical configuration so as to surround the hub 5, integrally and coaxially coupled to a rotational shaft 16 of the rotor 2, as illustrated in FIG. 2 which is a cross-sectional view taken along a line A—A in FIG. 1. The data keeping device 3 has a channel so as to coaxially accommodate therein the thermosensible ring 9. Near the data keeping device 3 is positioned a magnetic head 12 which acts as a data writing and reading device and which is secured to a base 11 of the rotation chamber 7. As illustrated in detail in FIG. 3, the data storing device 3 comprises a cylindrical sleeve 13 and a magnetic thin film 14 deposited on the outer surface of the cylindrical sleeve 13 so that the magnetic head 12 faces the magnetic thin film 14. The magnetic thin film 14 is covered by an adequate coating member 15 for protection purposes.

Figure 4:
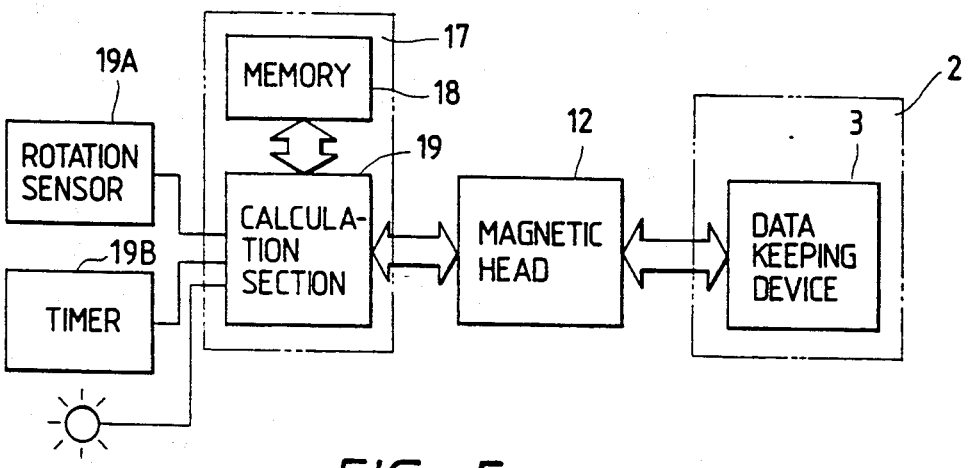
FIG. 4 is a block diagram showing a data processing unit of the management system illustrated in FIGS. 1 to 3.

The magnetic thin film 14 is arranged to keep the previous data such as the number of times of rotation and integrated working time written and recorded by means of the magnetic head 12. At the time of start of rotation of the rotor 2, the magnetic head 12 reads out the previous data recorded on the magnetic thin film 14. The read data are supplied to a data processing unit 17 provided in or on the centrifuge. As illustrated in FIG. 4, the data processing unit 17, which may be constructed by a well known microcomputer, comprises a calculation section 19 and a memory section 18. The read data are once stored directly in the memory section 18. Further, in response to the rotation of the rotor 2, the operation data such as the running time and the number of times of rotation of the rotor 2 are detected so as to obtain a new operation data which are in turn supplied to the calculation section 19. The operation data may be obtained by means of a rotation sensor 19A (not shown in FIGS. 1 to 3) provided in connection with the rotor 2 and a timer 19B (not shown in FIGS. 1 to 3) operable in response to the rotation of the rotor 2. It is also appropriate to obtain the operation data through the magnetic head 12 in connection with the rotation of the data storing device 2. When the rotor 2 is decelerated to a predetermined speed after completion of the sample separation, the calculation section 19 adds the detected new operation data to the previous operation data stored in the memory section 18 and writes the addition data in the data storing device 3 through the magnetic head 12, whereby the data storing device 3 can have the latest operation data.

With this arrangement, the operation data are recorded on the rotor 2 itself, and hence it is possible to use one rotor for a plurality of centrifuges. In addition, it is possible to eliminate the problem inherent to conventional centrifuges, i.e., the erasure of the operation data due to the excessive discharging of a battery, thereby allowing sure and accurate management of the lifetime of the rotor of the centrifuge.

Figure 5:
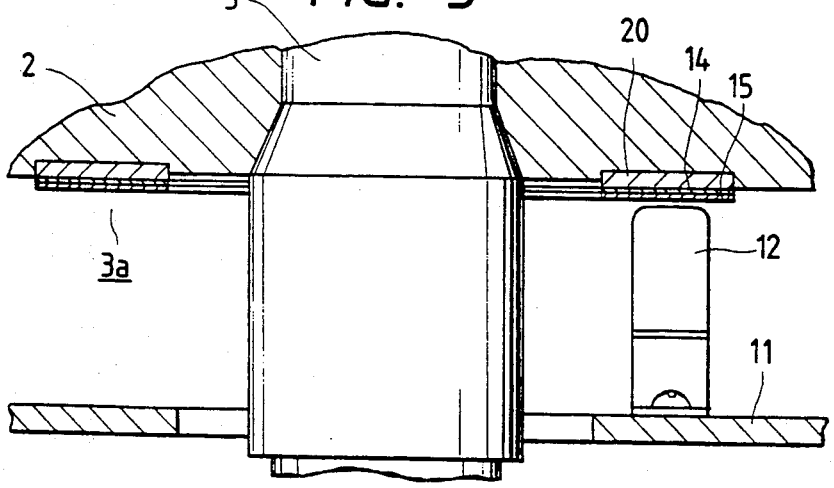
FIG. 5 is a partial cross-sectional view showing a second embodiment of this invention where the arrangments of a data storing device and a magnetic head are modified from that of FIG. 1 or 3.

FIG. 5 is a partial cross-sectional view of a centrifuge equipped with a management system according to a second embodiment of this invention, where parts corresponding to those in FIG. 1 are marked with the same numerals and the detailed description will be omitted for brevity. In FIG. 5, the management system includes a disc-like data keeping device **3*a* attached to a portion (for example, bottom surface) of a rotor 2 so as to coaxially surround a hub 5. The disc-like data storing device 3*a* comprises a disc-like member 20 to be fixedly secured to the rotor 2 and a magnetic thin film 14 deposited on the disc-like member 20. The magnetic thin film 14 is covered by an appropriate coating member 15. A magnetic head 12 is provided on a base 11 of a rotation chamber (not shown) so as to face the magnetic thin film 14 of the disc-like data keeping device 3*a*** which is electrically coupled to a data processing unit (not shown) having the same arrangement as the above-described first embodiment. This arrangement can provide the same effect as the first embodiment.

Figure 6:
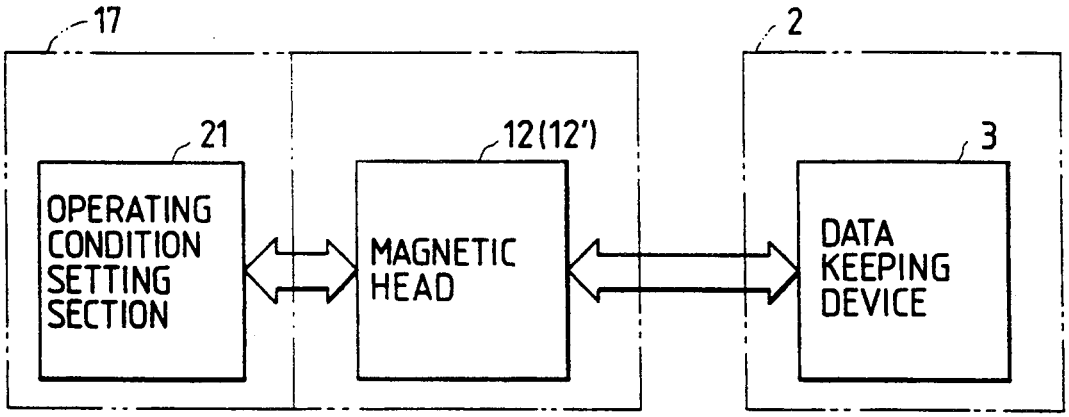
FIG. 6 is a block diagram showing an arrangement of a data processing unit of a management system according to a third embodiment of this invention.

A third embodiment of this invention will be described hereinbelow with reference to to FIG. 6 where parts corresponding to those in FIG. 4 are marked with the same numerals and the description thereof will be omitted. One feature of the third embodiment is that a data processing unit 17 of the management system includes an operating condition setting section 21 as illustrated in FIG. 6. The operating condition setting section 21 records operating condition data such as a rotational speed of a rotor 2 and a running time thereof on a data keeping device 3 through the magnetic head 12 or a different magnetic head 12', and reads out the operating condition data therefrom through the same magnetic head 12. The operating condition setting section 21 or the operator automatically or manually sets operating conditions corresponding to the read operating conditions to the centrifuge so that the operation of the centrifuge is started in accordance with the set operating conditions. Here, in the case of being required to change the operating condition, the operating condition setting section 21 records current operating condition data on the data storing device 3 through the magnetic head 12. In this case, the data recording may be performed with the rotor 2 being rotated at a low speed for instance.

Figure 7:
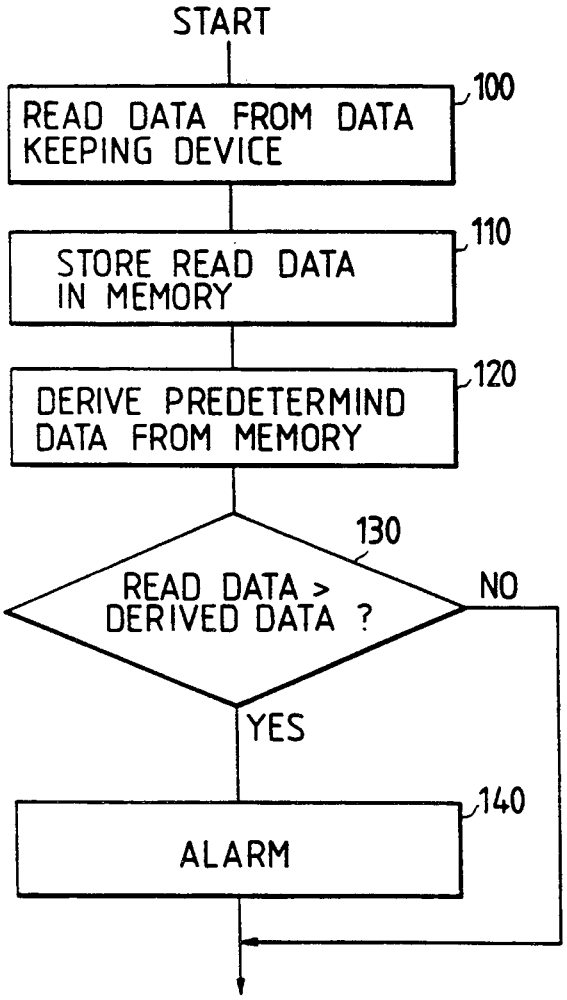
FIG. 7 is a flow chart for describing operation of a management system according to a fourth embodiment of this invention.

A fourth embodiment of this invention will be described hereinbelow with reference to FIG. 7. FIG. 7 is a flow chart showing an operation to compare the current operation data with predetermined data in order to check whether the current use of the rotor 2 reaches an allowable value. In FIG. 7, the operation starts with a step 100 to read the current operation data indicative of the current operation state of the rotor 2 from the data keeping device 3 through the magnetic head 12 at the time of start of the operation of the centrifuge- The calculation section 19 once stores the read current operation data in a step 110. In this case, the calculation section 19 has a register for storing the current operation data. In a step 120, the calculation section 19 reads out predetermined data indicative of the allowable value from the memory section 18. The predetermined data is in advance stored in the memory section 18. In a step 130, the calculation section 19 compares the current operation data with the predetermined data read out from the memory section 18. If the current data is greater than the predetermined data, that is, when the use of the rotor 2 exceeds the allowable value, a step 140 is executed so that the calculation section 19 generates an alarm signal to an alarm lamp 22 which in turm lights so as to prohibit a further use of the rotor 2 because of reaching the limitation imposed upon use.

Figure 8:
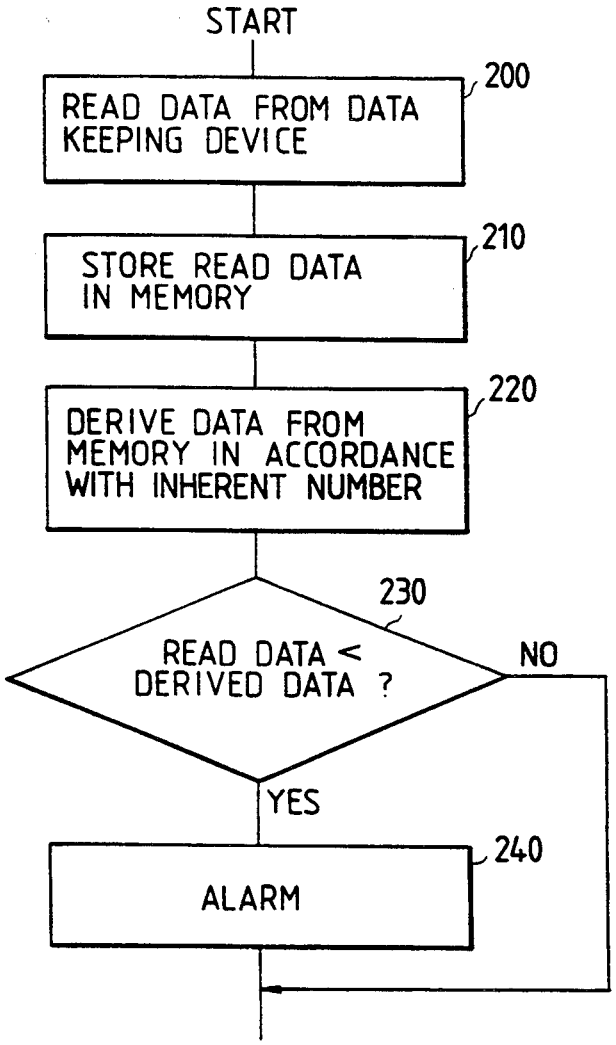
FIG. 8 is a flow chart for describing operation of a management system according to a fifth embodiment of this invention.

A fifth embodiment of this invention will be described with reference to FIG. 8. FIG. 8 is a flow chart showing an operation to check the accuracy of the operation data recorded on the data keeping device 3. The operation starts with a step 200 to read out the operation data from the data storing device 3, then followed by a step 210 to once store the read operation data in the register of the calculation section 19. In a subsequent step 220, the calculation section 19 reads out data indicative of a specific number of the rotor 2 from the data keeping device 3 and further reads out the operation data from the memory section 18, which operation data is stored in the memory section 18 after the completion of the previous operation of the rotor 2. In a step 230, the calculation section 19 compares the operation data read out from the data storing device 3 with the operation data read out from the memory section 18. If the operation data read out from the data storing device 3 is smaller than the operation data read out from the memory section 18, control goes to a step 240 in which the calculation section 19 generates an alarm signal to the alarm lamp 21 which in turn lights so as to indicate that the operation data recorded on the data storing device 3 is incorrect due to troubles of the data storing device 3, the rotor and others, thereby prohibitting the use of the rotor 2. This is based upon the fact that, because the latest operation data is always recorded on the data storing device 3, in the case of using one rotor for a plurality of centrifuges, the operation data recorded on the data storing device 3 is actually equal to or greater than the operation data stored in the memory section 18. With this arrangement, it is possible to prevent a trouble due to using the rotor 2.

Figure 9:
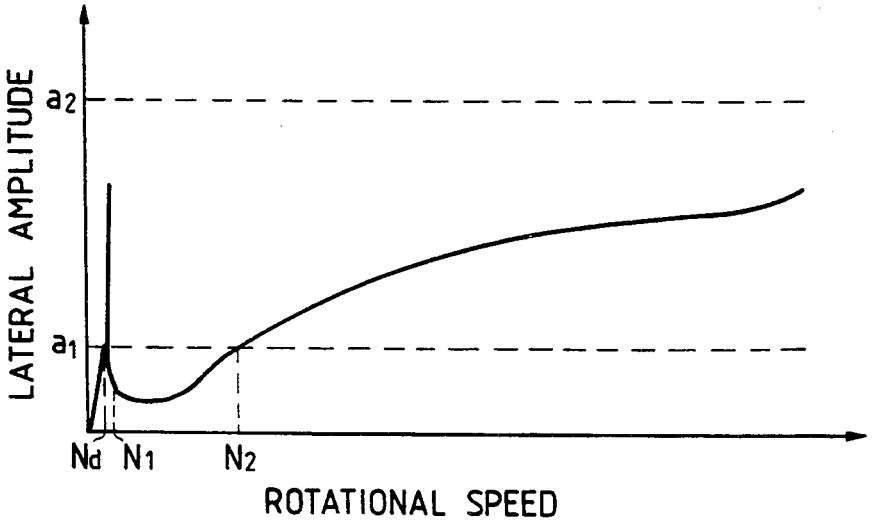
FIG. 9 is a graphic illustration for describing a sixth embodiment of this invention.

A description will be made hereinbelow in terms of a sixth embodiment of this invention. The sixth embodiment is based upon the fact that the magnetic head 12 is required to close to or come into contact with the data storing device 3 for data writing and reading operations, while for high-speed rotation of the rotor 2 the rotor 2 is required to be coupled through a small-diameter shift 16 to the driving apparatus 6 and the rotor 2 is used at a higher-speed side than the primary natural frequency of the shaft 16 . FIG. 9 shows the lateral amplitude of the data storing device 3 with respect to the rotational speed of the rotor 2. As obvious from FIG. 9, at the time of the primary natural frequency Nd and high-speed operation, the magnetic head 12 is required to be separated from the data storing device 3 by a distance a2 whereby the magnetic head 12 is not brought into contact with the data storing device 3. Thus, it is preferable that the magnetic head 12 is positioned at a detectable distance a1 when the rotor 2 is rotating at a low speed and separated from the data storing device 3 up to the distance a2 when the rotor 2 is rotating at a high speed.

Figure 10:
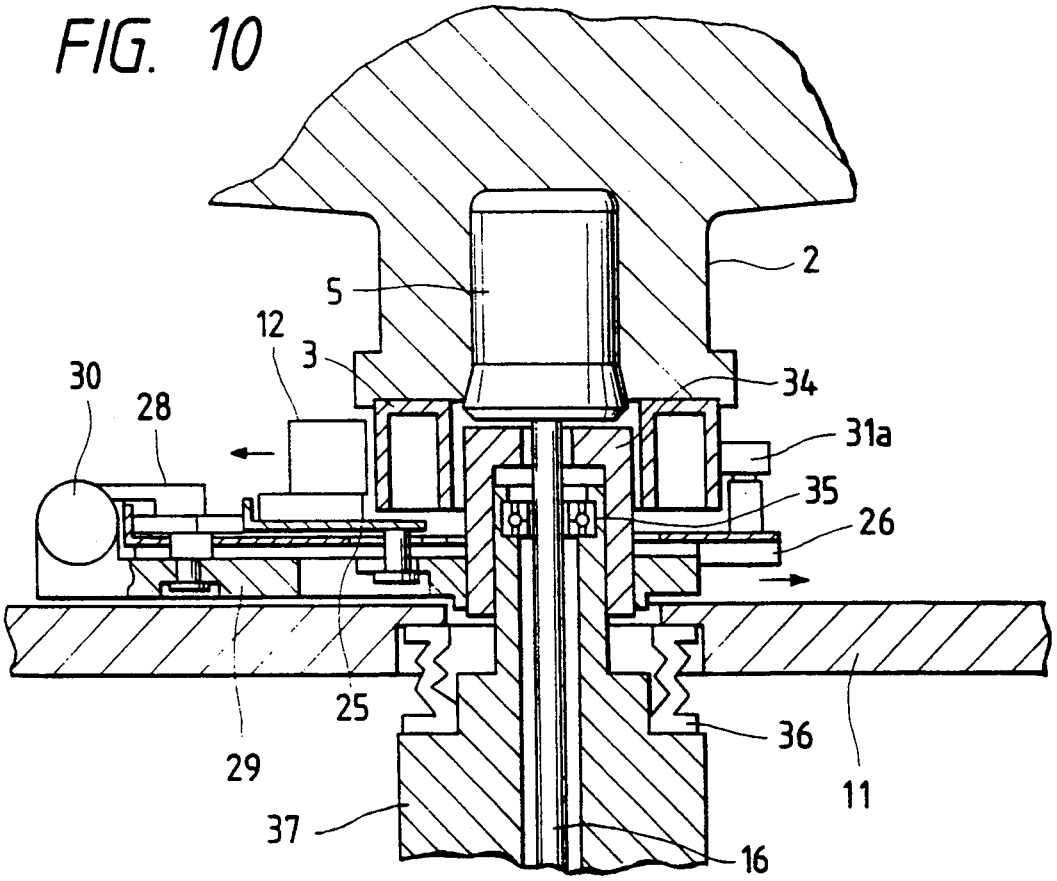
FIG. 10 is a cross-sectional view showing a magnetic head moving system of a management system according to the sixth embodiment.
Figure 11:
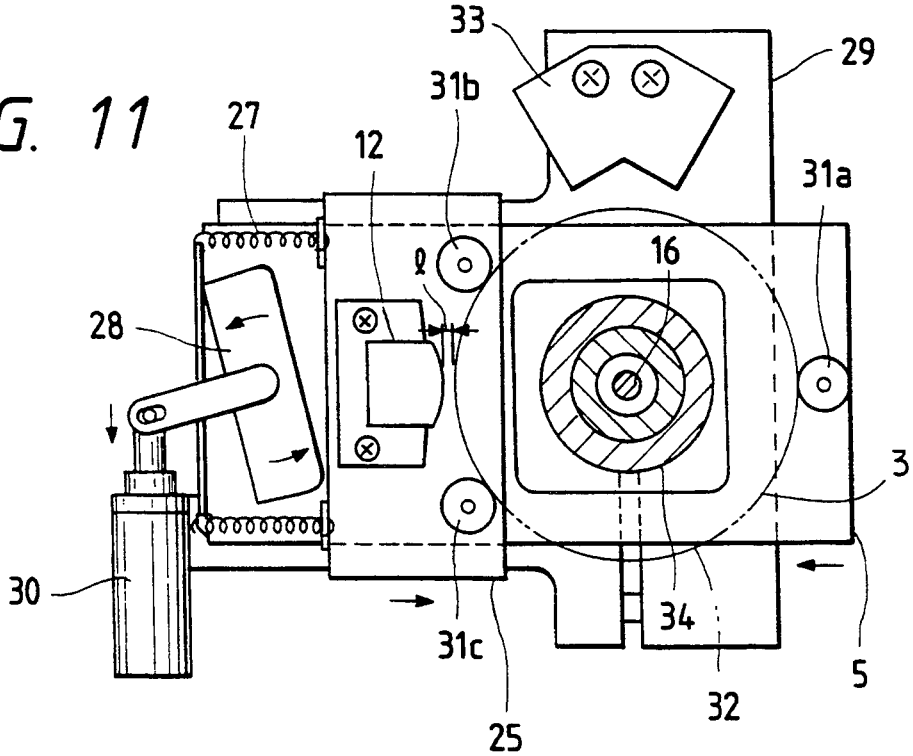
FIGS. 11 and 12 are plan views for describing the movement of the magnetic head moving system illustrated in FIG. 10.
Figure 12:
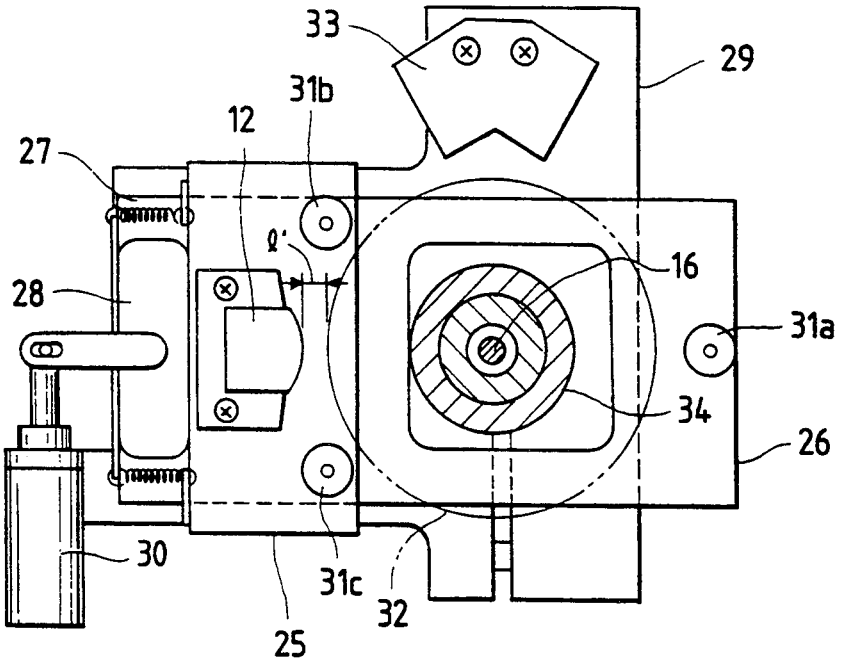

In FIGS. 10 to 12, on a lower portion of a rotor 2 is provided a data keeping device 3 which is rotatable together with a hub 5 coupled through a flexible shaft 16 to a driving apparatus, not shown. A magnetic head 12 is disposed so as to face the data storing device 3 to read and record data from and on the data storing device 3. The magnetic head 12 is fixedly provided on a head base 25 so as to be laterally slidable. Under the head base 25 is provided a clamp base 26 which is also arranged to be laterally slidable. The head base 25 and the clamp base 26 are respectively pulled by means of two springs 27 and a T-shaped bar 28 is disposed between the two springs 27 so that the head base 25 and the clamp base 26 are slidable in the opposite directions by means of rotation of the T-shaped bar 28. The T-shaped bar 28 is supported by a holder 29 so as to be rotatable through a solenoid 30 fixedly secured to the holder 29

As illustrated in FIG. 12, when the rotor 2 is stopping or rotating at a speed (up to N1 in FIG. 9) including the primary natural frequency Nd (100 to 400 $min^{-1}$), the magnetic head 12 and rollers 31*a* to 31*c*, which rotationally support the data storing device 3, are separated from the data storing device 3. In this case, the magnetic head 12 is separated from the edge 18 of the data keeping device 3 by a predetermined length l' (>a2). When the rotational speed of the rotor 2 exceeds N1 and reaches 1,000 $min^{-1}$ (for example), the solenoid 30 is energized in accordance with a control signal (which may be produced by the data processing unit 17), whereby the T-shaped bar is rotated so that the head base 25 and the clamp base 26 are respectively moved toward the data keeping device 3 so as to cause the three rollers 31*a* to 31*c* to support the data storing device 3 and permit the magnetic head 12 to approach the circumference of the data storing device 3 up to l (0<l<a1) as illustrated in FIG. 11. At this stage, the magnetic head 12 reads or records data from or on the data storing device 3. Thereafter, in response to deenergization of the solenoid 30, the head base 25 and the clamp base 26 are moved to be separated from the data storing device 3 by means of the two springs 27 so as to enter into the state illustrated in FIG. 12, and the rotor 2 is accelerated up to a sample-separation allowing speed. After the completion of the sample-separation, when the rotor 2 is decelerated up to 1,000 $min^{-1}$, the magnetic head 12 returns to the state as illustrated in FIG. 11 to write new data on the data storing device 3. In FIGS. 10 to 12, numeral 33 represents a photosensor, numeral 34 designates a rotation sensor, numeral 35 is a bearing, numeral 36 is a bellows, and numeral 37 is a housing.

Further, a description will be made hereinbelow in terms of a seventh embodiment of this invention. This embodiment is based upon the fact that for coupling the hub 5 to the rotor 2 the hub 5 is constructed to have a taper portion which is in turn coupled thereto, while the taper angles are different between a plurality of centrifuges so that the position of the data storing device 3 with respect to the magnetic head 12 varies, and hence difficulty is encountered to always keep the position of the data storing device 3 accurately and adequately with respect to the magnetic head 12, thereby providing a difficulty to accurately and surely read and record operation data from and on the data keeping device 3 due to double recording.

Figure 13:
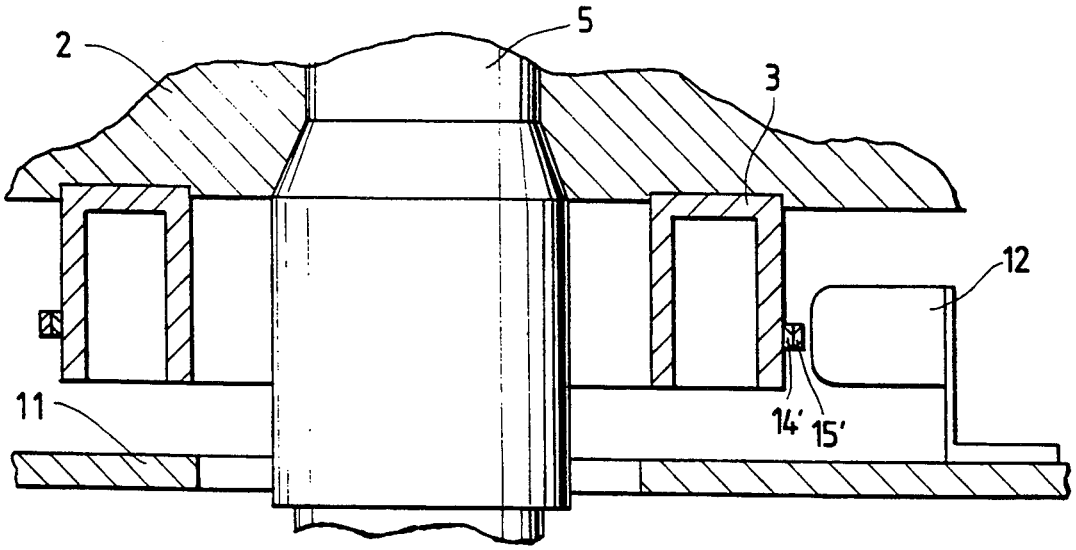
FIG. 13 is a partial cross-sectional view showing the arrangements of a data keeping device and a magnetic head of a management system according to a seventh embodiment of this invention.

As illustrated in FIG. 13, one feature of this embodiment is that the width of the magnetic thin film 14' of the data storing device 3 (length in directions of the axis of the rotor 2) is shorter than the width of the magnetic head 12 (length in the same directions). Since in practice the variation of the relative position of the data storing device 3 with respect to the magnetic head 12 is approximately 1 mm, when the track width due to the magnetic head 12 is 3 mm, it is preferable that the width of the magnetic thin film 14' is set to be below 2 mm. This arrangement allows preventing the reading and recording errors to ensure accurate management of the rotor 2 irrespective of using the rotor 2 for a plurality of centrifuges.

Figure 16:
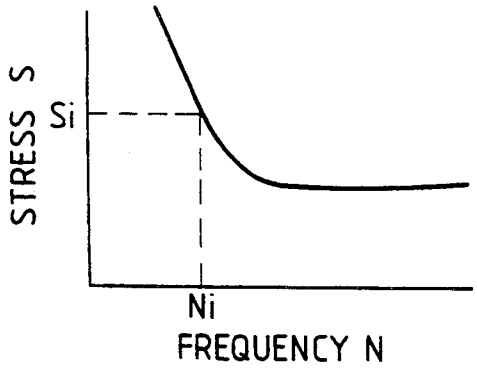
FIG. 16 is a graphic illustration useful for the understanding of the eighth embodiment.

Furthermore, a description will be described hereinbelow in terms of an eighth embodiment of this invention with reference to FIGS. 14 to 16. This embodiment is based upon the fact that the lifetime of the rotor 2 is generally determined depending on the allowable number of repetitions of use when the rotor 2 is always operated at the allowable rotational speed, while the lifetime of the rotor 2 can be prolonged in the case of operating the rotor 2 at speeds lower than the allowable rotational speed.

Figure 14:
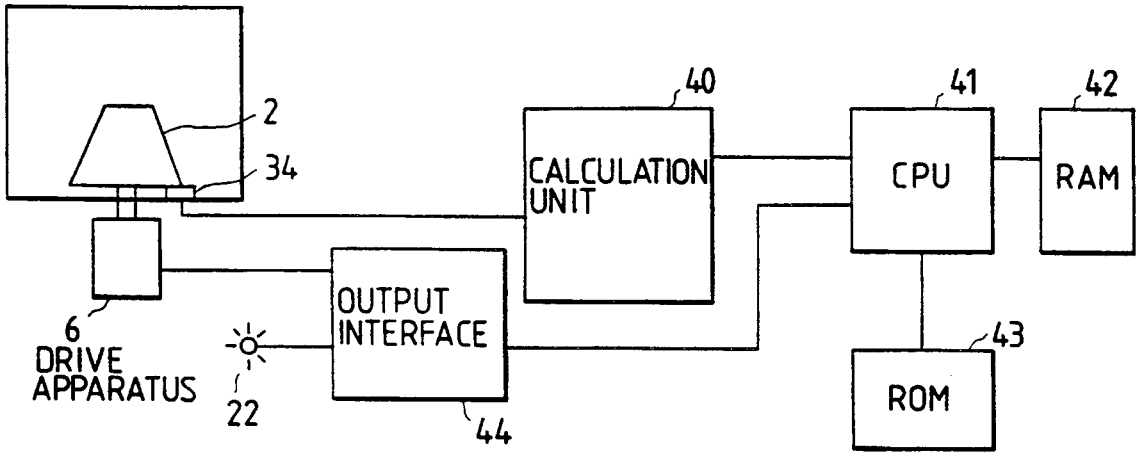
FIG. 14 is a block diagram showing an arrangement of a management system according to an eighth embodiment.
Figure 15:
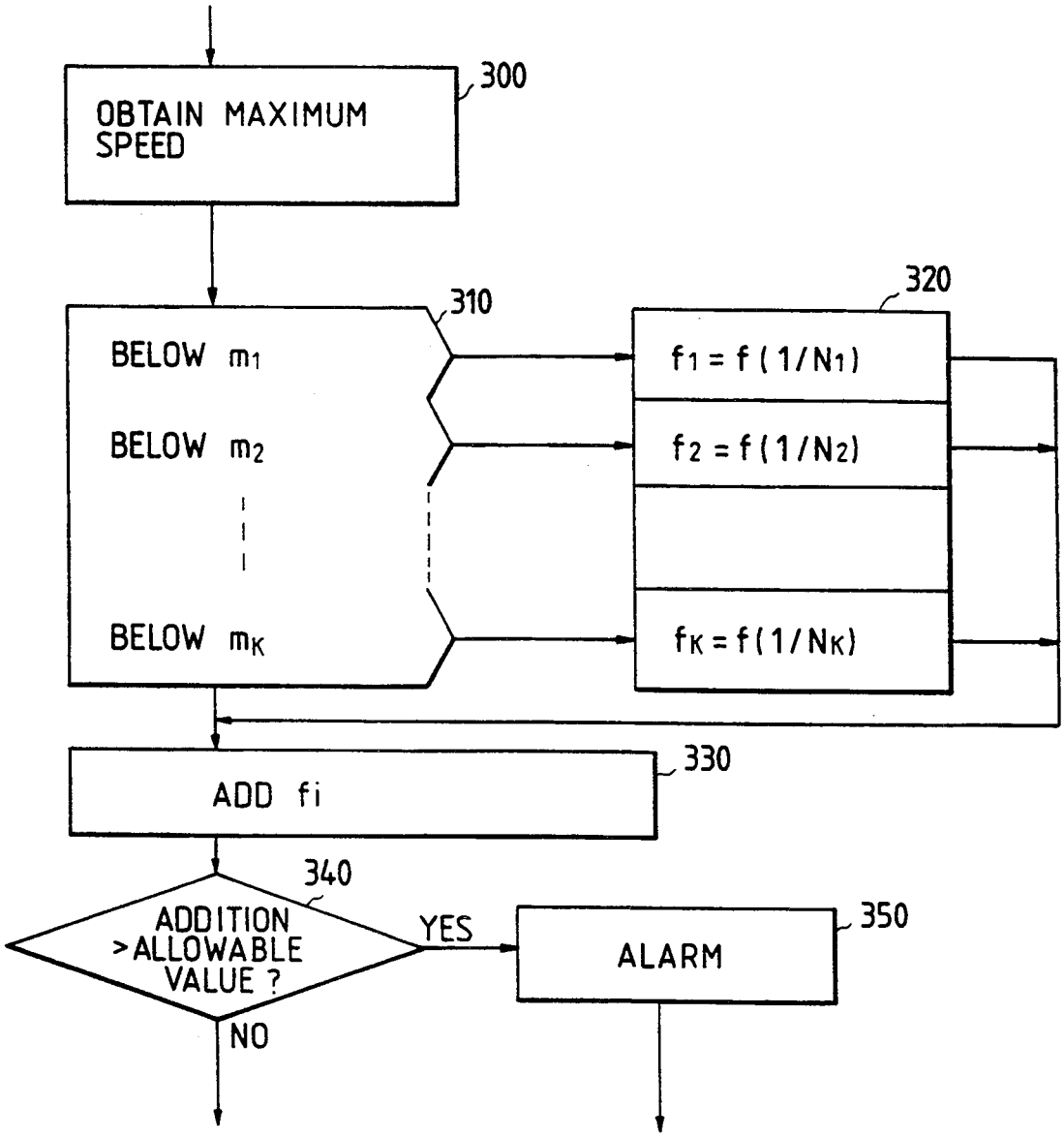
FIG. 15 is a flow chart showing the operation of the management system of the eighth embodiment.

The eighth embodiment is arranged as schematically illustrated in FIG. 14. That is, a rotation sensor 34 detects the rotational speed of the rotor 2 driven by a driving apparatus 6, and the detection signal of the rotation sensor 34 is supplied to a calculation unit 40 which is operable under control of a central processing unit (CPU) 41 coupled to a random access memory (RAM) 42 and further to a read-only memory (ROM) 43. The CPU is also coupled through an output interface 44 to an alarm lamp 22. The calculation unit 40 comprises classifying means for classifying the maximum rotational speed of the rotor 2 in accordance with a predetermined classifying method, rate calculating means for calculating a rate relating to a predetermined allowable frequency every classified rotational speed, and summing (or tabulating) means for summing the calculated rates , the summed values being compared with predetermined values to manage the lifetime of the rotor 2.

This operation will be described hereinbelow with reference to a flow chart of FIG. 15. In FIG. 15, the operation starts with a step 300 to obtain the maximum rotational speed taken during the use at the time of each completion of the sample-separating operation of the centrifugal separator. A step 310 follows to classify the maximum rotational speeds into predetermined classes (below m1, below m2 . . . below mk), then followed by a step 320 in which a coefficient is determined for each class- This coefficient can be obtained in accordance with a rule known as the minor formula. That is, the minor formula is that the stress S to be applied to a member and the frequency N resisting the application of the stress S are in a relation as indicated by a double-logarithmic graph in FIG. 16, i.e. so-called S-N curve, and if a frequency corresponding to a stress Si on the S-N curve is taken as Ni, the member will be damaged when the stress Si is applied to the member ni times, i.e., when $$\sum_{i=1}^{k} (ni/Ni) = 1.$$

In this embodiment, the function of 1/Ni in the aforementioned equation is used as the coefficient and multiplied by the number of repetition of use (usually, one operation=1). Here, it is also appropriate to use 1/Ni as it is. The summing is made from i=1 to i=k for the respective classes.

Returning again to FIG. 15 flow chart, the step 320 is followed by a step 330 to add the calculation result fi to the previous data, and further followed by a step 340 in order to check whether the addtion value exceeds an allowable value (1 for instance). If exceeding the allowable value, the alarm lamp 22 is turned on so as to stop further use of the rotor 2.

According to this embodiment, it is possible to calculate the remaining lifetime of the rotor 2. That is, the remaining value can be obtained by subtracting the current value from the allowable value, and the remaining number of repetition of rotation when the rotor 2 is rotated at a given speed can be obtained by dividing the subtraction result by the corresponding coefficient. These data for lifetime management are stored in the RAM 42 and/or recorded on the above-mentioned data keeping device 3 through the magnetic head 12.

Figure 17:
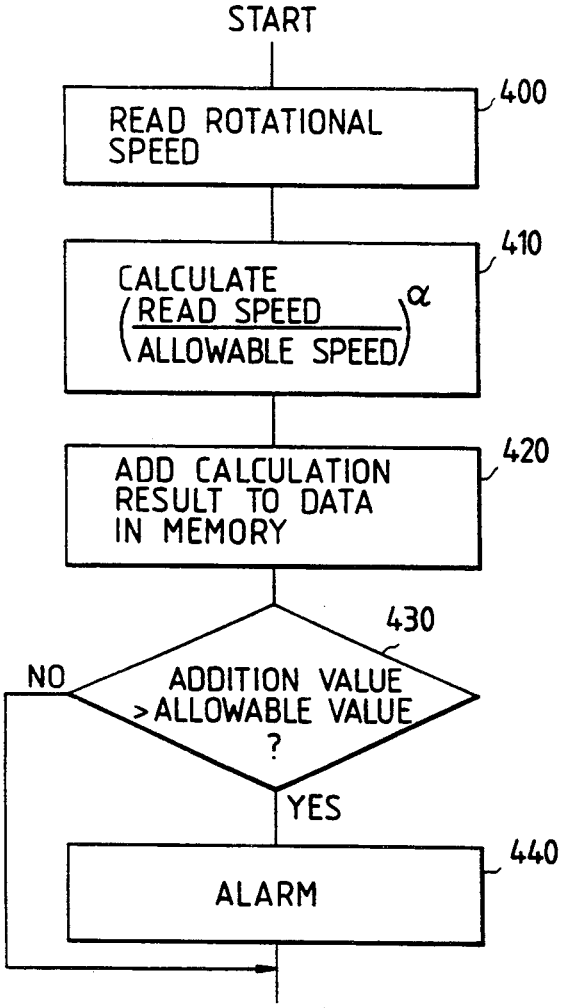
FIG. 17 is a flow chart showing the operation of a management system according to a ninth embodiment of this invention.

A ninth embodiment of this invention will be described hereinbelow with reference to FIG. 17 which is a flow chart showing the operation of this invention. The arrangement for executing this operation can be similar to that illustrated in FIG. 14. In FIG. 17, the operation of this embodiment, executed at every use of the rotor 2, starts with a step 400 to read the used rotational speed after completion of the drive of the rotor 2. A step 410 follows to calculate the ratio of the read rotational speed to an allowable rotational speed and further raise to $\alpha$th power with respect to the calculated ratio. Here, $\alpha$ is determined in connection with the fact that the stress is proportional to the second power of the rotational speed and the S-N curve varies in accordance with the material of the member (rotor 2). In a subsequent step 420, the value (below 1) calculated in the step 410 is added to the previous value (value stored in a memory). A step 430 is provided in order to check whether the addition value is compared with an allowable value (allowable number of repetitions). If the addition value exceeds the allowable value, the operation advances to a step 440 to generate an alarm signal to light the alarm lamp 2.

For determining the limitations of the rotational speed the rotor 2, if the rotor 2 is made of a titanium, the stress is obtained under the determination that the number of repetition of use is 5,000. The stress of the rotor 2 depends on its configuration or shape and the rotational speed, and hence it is possible to obtain the allowable rotational speed. Thus, in the case of always using the rotor 2 at the allowable rotational speed, the allowable number of repetition of use N becomes 5,000.

Figure 18:
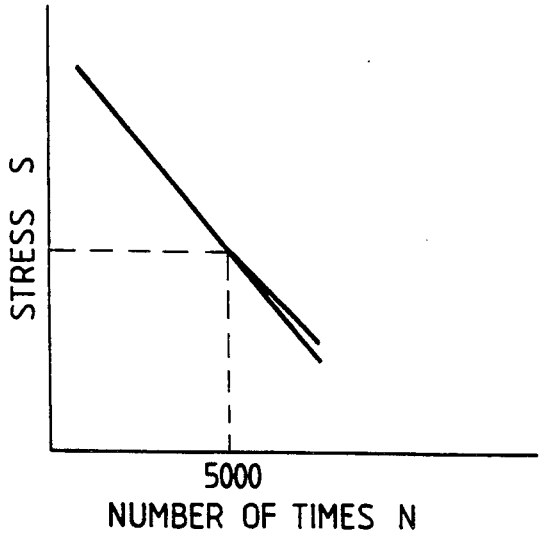
FIG. 18 is a graphic illustration useful for describing the operation of the management system of the ninth embodiment.

FIG. 18 is a graphic diagram showing a S-N curve. In FIG. 18, a tangential line is drawn at a lower stress side and the approximate value of this tangential line is obtained. In the case that the rotor 2 is made of a titanium, the approximation becomes as follows.

$N \bullet S^3 = \text{constant}$

Since the stress is proportional to the second power of the rotational speed, the following can be given.

$N \bullet (\text{rotational speed})^6 = \text{constant}$

In the case that the used rotational speed is constant, the number of repetition of use is increased in proportion to (allowable rotational speed/used rotational speed)$^6$. Thus, it is possible to determine the lifetime of the rotor 2 by counting (used rotational speed/allowable rotational speed)$^\alpha$ at every drive of the rotor 2.

It should be understood that the foregoing relates to only preferred embodiments of the present invention, and it is intended to cover all changes and modifications of the embodiments of the invention herein used for the purposes of the disclosure, which do not constitute departures from the spirit and scope of the invention. For example, although the operation data are magnetically recorded on the data keeping device through the magnetic head, it is also appropriate to optically record the operation data on the data storing device.

What is claimed is:

1. A management system for use in a centrifuge equipped with a detachable rotor which is rotatable so as to separate density-different samples by a centrifugal force due to the rotation, said management system comprising:

detection means for monitoring the rotation of said rotor so as to detect rotational operating conditions of said rotor; and data storing means, provided on said rotor, for storing data indicative of said rotational operating conditions, said data storing means being arranged so that said data is read out and altered based on said detected rotational operating conditions, and the altered data written into said data storing means.

2. A management system as claimed in claim 1, further comprising data processing means responsive to said rotational operating conditions detected by said detection means, wherein said data storing means is composed of a magnetic recording medium and said data processing means include a magnetic head, and wherein said data is read out from said magnetic recording medium and said altered data written onto said magnetic recording medium through said magnetic head.

3. A management system as claimed in claim 2, further comprising setting means for recording predetermined conditional data of the rotor onto said magnetic recording medium and for setting present centrifuge rotational operating conditions to correspond to said predetermined conditional data so that said centrifuge is operable in accordance with said predetermined conditional data which is read out from said magnetic recording medium through said magnetic head.

4. A management system as claimed in claim 2, further comprising memory means coupled to said data processing means for storing and taking out data and alarm means coupled to said data processing means for giving an alarm, and wherein said data processing means reads out the operating conditions from said data storing means at the time of start of the operation of said centrifuge and records new operating conditions thereon at the time of completion of the operation of said centrifuge, and further said data processing means compares the operating conditions read out from said data storing means with allowable conditions taken out from said memory means and operates said alarm means in accordance with the comparison results.

5. A management system as claimed in claim 2, wherein said magnetic head is arranged to be positioned a predetermined distance from said magnetic recording medium in response to a control signal from said data processing means so that said magnetic head reads out said data from said magnetic recording medium and writes said data onto said magnetic recording medium, and wherein said data processing means generate said control signal when said rotor is slowing while still rotating at a speed higher than a predetermined speed.

6. A management system as claimed in claim 2, wherein a width of said magnetic recording medium in directions of the axis of said rotor is shorter than a width of said magnetic head in the same directions.

7. A management system as claimed in claim 2, wherein said detection means detects rotational speeds of said rotor at every use of said centrifuge, and said data processing means comprises means for classifying the maximum speed of the detected rotational speeds in accordance with a predetermined classifying system, rate-calculating means for calculating a rate for each class, and summing means for summing the calculated rates, and comparing means for comparing the summed value with a predetermined value so as to manage said rotor in accordance with the comparison results.

8. A management system as claimed in claim 2, wherein said detection means detects rotational speeds of said rotor, and said data processing means comprises means for calculating a ratio of the detected rotational speed to a predetermined value at every use of said centrifuge, adding means for adding the calculated ratio to the previously calculated ratio at every use of said centrifuge, and comparing means for comparing the addition value with a predetermined value to manage said rotor in accordance with the comparison results.

9. A management system as claimed in claim 1, wherein said data storing means comprises a cylindrical sleeve, a magnetic thin film deposited on an outer surface of said cylindrical sleeve and a coating member for covering said magnetic thin film.

10. A management system as claimed in claim 1, wherein said data storing means is composed of a cylindrical disc provided on said rotor to be coaxial with said rotor, a magnetic thin film deposited on said cylindrical disc, and a coating member provided on said magnetic thin film to cover said magnetic thin film.

11. A management system for use in a centrifuge equipped with a detachable rotor which is rotatable so as to separate density-different samples by a centrifugal force due to the rotation, said management system comprising:

detection means for monitoring the rotation of said rotor so as to detect rotational operating conditions of said rotor;

data storing means, provided on said rotor, for storing data indicative of said rotational operating conditions; and means for altering said data based on said detected rotational operating conditions and for writing said altered data in said data storing means.

12. A management system as claimed in claim 11, wherein said detection means comprise sensor means for monitoring the rotation of said rotor, wherein said data storing means comprise a magnetic recording medium, and wherein said altering and writing means comprise a magnetic head.

* * * * *